United States Patent [19]

Davidson et al.

[11] 4,033,859

[45] July 5, 1977

[54] THERMAL TREATMENT OF USED PETROLEUM OILS

[75] Inventors: Donald Douglas Davidson, Pasadena; Bjorn I. Engesvik, Bakersfield, both of Calif.

[73] Assignee: Witco Chemical Corporation, New York, N.Y.

[22] Filed: Apr. 24, 1975

[21] Appl. No.: 571,114

[52] U.S. Cl. ..... 208/179

[51] Int. Cl.[2] ..... C10M 11/00

[58] Field of Search ..... 208/179

[56] References Cited

UNITED STATES PATENTS

| | | | |
|---|---|---|---|
| 1,778,831 | 10/1930 | Jones | 208/179 |
| 3,923,643 | 12/1975 | Lewis et al. | 208/179 |
| 3,954,602 | 5/1976 | Troesch et al. | 208/179 |
| 3,990,963 | 11/1976 | Audibert et al. | 208/179 |

FOREIGN PATENTS OR APPLICATIONS

| | | | |
|---|---|---|---|
| 328,558 | 4/1930 | United Kingdom | 208/179 |
| 508,099 | 9/1937 | United Kingdom | 208/179 |

*Primary Examiner*—Delbert E. Gantz
*Assistant Examiner*—James W. Hellwege
*Attorney, Agent, or Firm*—Albert L. Gazzola; Morton Friedman

[57] ABSTRACT

Used oil, such as automotive crankcase oil drainings from internal combustion engines, are pretreated by heating to above about 400°–800° F, and preferably between 600°–750° F, while an essentially liquid phase system is maintained at a pressure of between 500–3500 p.s.i.g., preferably between 2000–3500 p.s.i.g., for between 15–60 minutes, the contact time being even shorter at higher temperatures. A sludge which contains contaminants, such as insoluble degradation products, metallic compounds, and water, is separated preferably by centrifugation, leaving a substantially ashless oil ready for additional refinement to a high quality lubricating oil, or it may be used, per se, as a fuel oil.

5 Claims, No Drawings

THERMAL TREATMENT OF USED PETROLEUM OILS

This invention relates to an improved substantially nonpolluting and economical preliminary treatment method of recycling used oil and more particularly automotive crankcase oil drainings from internal combustion engines, whereby water, metals, carbon particles, and other contaminants are separated from the oil as a sludge by a heat-pressure treatment, as will hereinafter by more fully described. The remaining oil, after removal of the sludge, is ready for further treatment to a refined lubricating oil, or it may be used, per se, as a fuel oil. This pretreated oil may be further refined for instance, by filtration, distillation, and hydrotreatment, or by the traditional acid-clay treatment, as determined by the artisan.

The present process makes possible a pretreated oil product, from which, by only a single distillation and hydrogenation, for instance, as more fully described hereinafter, an excellent grade lubricating oil is obtainable in high yield.

Lubricating oils used in internal combustion engines are subject to high temperatures and pressures which not only cause oxidation of the oil itself but also result in the decomposition of additives such as organic and inorganic metallic compounds found in gasolines, viscosity index improvers, rust inhibitors, and the like. Still other contaminants which find their way into the lubricating oil are solids such as dirt, foreign metallic particles, carbonaceous matter, and the like. In the recycling of waste crankcase oils, all these contaminants must be removed.

Although the recycling of used lubricating oil has been the subject of intensive research over the years, with the development of many recycling processes, because of the high cost and/or pollution resulting from the known recycling processes, much of the used oil is still burned or dumped. Such practices are not only polluting but they are wasteful, because of the economic loss of the values in the used oil, particularly in view of the diminishing supply of available petroleum and associated products. In the interest of conservation and ecology, it would be desirable to have available a process for recovering used lubricating oil and the values therein, which is economical as well as nonpolluting.

The known procedures for removing contaminants from used lubricating oil include, for instance, expensive multiple distillation, clay and acid treatments, to remove both water and soluble and insoluble impurities. Clay and acid treatment of the crude used oil produces foul smelling acid residues which pose serious disposal problems. Pretreatment by multiple distillation procedures are costly and ineffective because of the repeated application of very high temperatures which results in excess cracking of the oil.

U.S. Pat. No. 3,791,965, issued to Fitzsimons et al. on Feb. 12, 1974, for instance, discloses a process for recycling used oil by multiple distillations at progressively higher temperatures and lower pressures. The disclosure in this patent including the prior art cited therein, is incorporated herein by reference.

Other known art includes U.S. Pat. No. 3,169,917, issued to Kahan on Feb. 16, 1965; U.S. Pat. No. 3,625,881, issued to Chambers et al. on Dec. 7, 1971; and U.S. Pat. No. 3.098,031, issued to Harris on Sept. 30, 1958. None of these patents, or combination thereof, suggest the present liquid phase heat-pressure pretreatment of used oils to yield a substantially ashless oil as presently disclosed.

Diesel type waste oils may be recycles by multiple distillation as disclosed in the patent of Fitzsimons, supra, without any pretreatment, because they do not contain lead or zinc, for instance, or other engine-produced contaminants normally present in used internal combustion engine crankcase oil. With crankcase oils, meaning waste lubricating oils from gasoline driven engines, because of the additional contaminants, they must be desludged to a tolerable level of ash, stripped of water and heavy metals, such as lead and other metals such as sodium, and other contaminants such as chlorine, before distillation or hydrotreatment refinement can be successfully accomplished, with a minimum of pollution and manipulation. Traces of these contaminants, particularly metals such as lead, tend to deactivate catalysts which are used in finishing hydrotreating processes to stabilize the refined oil.

The present invention makes available a simple economical and practical pretreatment of used automotive crankcase oil with a minimum of pollution, wherein water and the bulk of metallic compounds and other soluble and insoluble degredation products are separated with a minimum of oil cracking. A single distillation and hydrotreatment of this pretreated oil, for instance, is all the treatment needed to yield a high quality lubricating oil.

By the present process, the used oil is subjected to a temperature of from between about 400°–800° F for a few minutes or even less, up to about 2 hours, at a pressure up to about 3500 p.s.i.g., the contact time being shorter at the higher temperatures. Preferably the oil is heated at a temperature of about 600°–750° F for a period of about 15 to about 60 minutes, at a pressure of between about 2000–3500 p.s.i.g. to insure the maintenance of a liquid phase. The resultant sludge is separated from the oil, preferably by centrifuging, The separated oil is substantially reduced in ash content and contains little of the heavy metals and other impurities of the starting used crankcase oil.

It is to be noted that extending the present heat-pressure treatment beyond two hours, i.e. for 3 or 4 hours, or even longer, has little effect on the yield or quality of the recovered oil. The contact time, therefore, for any particular run, is dependent upon practical considerations and the judgement of the artisan.

In addition, as to the pressure, the pressure in the reaction vessel builds up as heat is applied, but normally additional pressure must be applied. This may be accomplished by means known in the art, such as by using a pressurized inert gas such as nitrogen, for instance, to maintain an essentially liquid phase in the reactor during the heat-pressure treatment. Depending on the composition of the used oil, and the temperature, a liquid phase may develop at pressures of as little as about 400–500 p.s.i.g., but in most cases, it is necessary to develop a pressure of over 2000 p.s.i.g. to insure the maintenance of an essentially liquid phase in the reactor.

After this pretreatment, the separated oil lends itself to further refinement by a single distillation and hydrogenation, for instance, to yield an oil product of high quality with excellent color and color stability. There is no need for multiples distillations and acid-clay treatments as is the case with prior art processes, to produce a high quality lubricating oil from this pretreatment oil poduct.

Distillation of the separated oil may be accomplished, for instance, at about 1.0 mm up to about 10 mm. vacuum. At between 40°–45° C up to below 150° C, residual water and light ends amounting to about 10–15 v/percent are easily taken off as a top cut. A middle fraction amounting to 70–80 v/percent distilling over between 150°–350° C, is collected for further treatment. The residue containing all remaining metals and carbon insolubles generally amounts to about 10–15 v/percent. A high grade lubricating oil is recovered from the middle cut, above, after hydrotreatment at about 700–1000 p.s.i.g. or higher, at 600°–750° F, using cobalt-molybdenum or nickel-molybdenum, for instance, on an alumina base, as known in the art. A preferred catalyst is a nickel-molybdenum on alumina base, manufactured by the American Cyanimid Company under the trade name AERO-HDS3, and having the following composition, NiO: 3.0–4.0%

$MoO_3$: 14.5–16%

The topped oil from the distillation above, may be further refined and used in gasoline or diesel oil, as the case may be. The residual sludges can also be of value for metals recovery through incineration, as known in the art.

A typical sludge from the Thermal Treatment of a used lubricating oil contains the following metals (ppm): Pb . . . 45,000; Ca . . . 10,000; P . . . 5,000; Zn . . . 5,000; Fe . . . 3,000; Ba . . . 3,000; Na . . . 1,500; Mg . . . 1,000; Cu . . . 300; Al . . . 200; Cr . . . 150; B . . . 100; Sn . . . 100; Si . . . 100; Ni . . . 5; Ag . . . 0.5.

About 80–90 percent of recycled lubricating oil, depending upon the compositon of the starting waste oil, is recovered from the above treatment.

The following tables summarize comparative results of the product of pretreatment of a waste crankcase oil, according to the present invention, and the product of subsequent distillation and hydrotreatment. The distillation is carried out under vacuum, as stated hereinafter, and the heart fraction, distilling in the range of between about 150°–350° C, is collected.

TABLE I

| | A | B | C | D |
|---|---|---|---|---|
| Gravity, ° API | 23.9 | — | — | 30.4 |
| Viscosity, csts at 100° F | 66.64 | — | 39.25 | 35.87 |
| Viscosity, csts at 210° F | 9.93 | — | 5.77 | 5.62 |
| Viscosity, SSU at 100° F | 329 | 190 | 182.7 | 167.6 |
| Viscosity, SSU at 210° F | 59.1 | — | 45.2 | 44.6 |
| VI | 144 | — | 95 | 104 |
| Color, D-1500 | N.T. | N.T. | — | L1.0 |
| Color Stability, 24 Hrs, at 115° C | — | — | — | L1.5 |
| Neut. No., D-974 | 3.9 | 2.3 | 0.9 | 0.01 |
| Pour Point, ° F | — | — | — | +30 |
| Ash, Sulfated, w% | 1.52 | 0.06 | 0.00 | 0.00 |
| Ash Removal, % | — | 96.1 | 100 | 100 |
| Sulfur, w% | 0.49 | — | — | 0.002 |
| Nitrogen, Basic, ppm | 690 | — | — | 5.6 |
| Coagulated Pentane Insoluble | 5.0 | — | 0.07 | 0.001 |
| Pb, ppm | 8000 | 200 | Nil | Nil |

TABLE I-continued

| | A | B | C | D |
|---|---|---|---|---|
| Pb Removal, % | — | 97.5 | 100 | 100 |

A Used Automotive Oil As Received.
B A continuously treated at 680° F, 3000 psi, 60 min. contact time, centrifuged.
C Vacuum distillation of B, 10–88.5% Heart Cut.
D Hydrogenation of C at 680° F, 2 LHSV, using Nickel-Molybdenum catalyst (AERO-HDS3), 6% of light ends removed.

TABLE II

"THERMAL TREATMENT" (CONTINUOUS OPERATION) OF USED AUTOMOTIVE OIL. METAL CONCENTRATION STUDY

| | | A | B | C | D | E | F |
|---|---|---|---|---|---|---|---|
| Fe, | ppm | 275 | 330 | 220 | 170 | 29 | <1 |
| Pb, | ppm | 8000 | 3000 | 3000 | 900 | 200 | <5 |
| Cu, | ppm | 50 | 24 | 19 | 5 | <1 | <1 |
| Cr, | ppm | 10 | 8 | 9 | 2 | <1 | <1 |
| Al, | ppm | 15 | 15 | 15 | 10 | <1 | <1 |
| Ni, | ppm | <1 | <1 | <1 | <1 | <1 | <1 |
| Ag, | ppm | <0.1 | <0.1 | <0.1 | <0.1 | <0.1 | <0.1 |
| Sn, | ppm | 5 | 14 | 9 | 5 | <5 | <5 |
| Si, | ppm | 30 | 30 | 22 | 15 | 6 | 9 |
| B , | ppm | 15 | 25 | 15 | 11 | 5 | <1 |
| Na, | ppm | 90 | 120 | 85 | 60 | 16 | 5 |
| P , | ppm | 1500 | 1000 | 800 | 500 | <100 | <100 |
| Zn, | ppm | 900 | 800 | 500 | 300 | <100 | <100 |
| Ca, | ppm | 1500 | 1000 | 900 | 500 | <100 | <100 |
| Ba, | ppm | <500 | <500 | <500 | <500 | <500 | <500 |
| Mg, | ppm | 125 | 130 | 90 | 65 | <1 | <1 |

A Used Automotive Oil, As Received.
B A treated at 650° F, 3000 psi, 30 min. contact time, centrifuged.
C A treated at 675° F, 3000 psi, 30 min. contact time, centrifuged.
D A treated at 700° F, 3000 psi, 30 min. contact time, centrifuged.
E A treated at 680° F, 3000 psi, 60 min. contact time, centrifuged.
F E vacuum distilled, 10–88.5% heart cut.

TABLE III

"THERMAL TREATMENT" (BATCH OPERATION) OF USED AUTOMOTIVE OIL

| | A | B | C |
|---|---|---|---|
| Viscosity, SSU at 100° F | 329 | — | 214 |
| Viscosity, SSU at 210° F | 59.1 | — | 50.2 |
| Ash, Sulfated, w% | 1.52 | 0.15 | 0.02 |
| Ash Removal, % | — | 90.1 | 98.7 |
| Coagulated Pentane Insolubles | 5.0 | 1.22 | 0.07 |
| Coagulated Benzene Insolubles | — | 0.25 | 0.001 |
| Pb, ppm | 8000 | 90 | 40 |
| Pb Removal, % | — | 98.9 | 99.5 |

A Used Automotive Oil, As Received.
B A treated at 500° F, 800 psi, contact time: 4 hours.
C Same as B, but centrifuged.

We claim:

1. An improved process in the recycling of used automotive crankcase oil comprising heating said oil in an essentially liquid state at a temperature of between about 400°–800° F under a pressure of about 500–3500 p.s.i.g. and thereafter separating the formed sludge from the substantially ashless oil product.

2. A process as in claim 1 wherein the temperature is about 600°–750° F and the pressure, about 2000–3500 p.s.i.g.

3. A process as in claim 1, wherein the sludge is separated by centrifuging.

4. A process as in claim 1, wherin the reaction is continued for less than two hours.

5. A process as in claim 2, wherein the reaction is continued for between about 15 to 60 minutes.

* * * * *